United States Patent [19]

Tanabe et al.

[11] Patent Number: 5,002,647

[45] Date of Patent: Mar. 26, 1991

[54] PROCESS FOR PREPARATION OF THICK FILMS BY ELECTROPHORESIS

[75] Inventors: Hiroyoshi Tanabe; Seitaro Fukushima, both of Muroran; Etsuji Kimura, Omiya, all of Japan

[73] Assignee: Mitsubishi Metal Corporation, Tokyo, Japan

[21] Appl. No.: 382,283

[22] Filed: Jul. 20, 1989

[30] Foreign Application Priority Data

Jul. 21, 1988 [JP] Japan ..... 63-180377

[51] Int. Cl.[5] ..... C25D 13/02

[52] U.S. Cl. ..... 204/181.1; 204/181.5; 204/181.7

[58] Field of Search ..... 204/181.1, 181.5, 181.7

[56] References Cited

U.S. PATENT DOCUMENTS 3,770,604 11/1973 Seiner ..... 204/181.1

4,482,447 11/1984 Mjizuguchi et al. ..... 204/181.5

*Primary Examiner*—T. Tung

*Assistant Examiner*—David G. Ryser

*Attorney, Agent, or Firm*—Oblon, Spivak, McClelland, Maier & Neustadt

[57] ABSTRACT

In the process for preparing thick films comprising dispersing powder of a starting material for thick films in a solvent system, applying direct electric potential between the electrodes provided in the solvent system and thus electrodepositing the powder material on a substrate connected to the cathode, an improvement wherein a mixed solvent comprising an alcohol or alcohols, a methyl-group-containing ketone or ketones and nitorcellulose is disclosed. By this process thick films of solid electrolytes can be economically formed.

5 Claims, 3 Drawing Sheets

PROCESS FOR PREPARATION OF THICK FILMS BY ELECTROPHORESIS

FIELD OF THE INVENTION

This invention relates to a process for preparing thick films, especially of solid electrolyte, by means of electrophoresis.

Solid electrolytes are widely used in high temperature type fuel cells and various kinds of solid sensors and as materials for electronic engineering. This invention provides a simple process for economically preparing thick films of solid electrolytes.

BACKGROUND OF THE INVENTION

Processes for preparing thick films by electrophoresis have been known. Preparation of films by electrophoresis comprises suspending a powder of the starting material in a solvent system (liquid medium), applying an electric field to the suspension using, as the cathode, a substrate plate on which a film is to be formed and thus causing the charged particles in the solvent system to be deposited on the surface of the substrate by electrically attracting said particles.

Although preparation of films by electrophoresis is practised for formation of films of various compositions, there is known no case wherein films of solid electrolytes were prepared by electrophoresis. Further, known processes for preparation of films by electrophoresis are practised with electroconductive or semielectroconductive substrates, and films cannot be formed on the surface of oxide substrates which are strong insulators. Also, no attempt has been made to prepare laminated films. That is, only single layer films were made by the conventional method.

We sought to develop an improved method of electrophoretic formation of films and found that the property of the formed film is greatly influenced by the composition of the solvent system used. Thus we conducted a study to find a suitable solvent system and have found a solvent system of a specific composition which enables formation of films on oxide substrates, which has been difficult, and the preparation of excellent thick films of solid electrolytes can be prepared.

SUMMARY OF THE INVENTION

This invention provides, a process for preparing thick films by suspending a powder of a starting material for the film in a solvent system, applying an electric field between an anode and a cathode provided in the solvent system, and thus causing the powder to be deposited on the surface of a substrate connected to the cathode terminal. In this process a solvent system comprising an alcohol or alcohols, a methyl-group-containing ketone or ketones and nitrocellulose is used.

Further, this invention provides, as a preferred embodiment, a process for preparing thick film of solid electrolytes.

Also, this invention provides, in a process for preparation of thick film of solid electrolyte, a process in which the cathode substrate plate is an insulator oxide and the solvent system comprises methyl alcohol, hexyl alcohol, acetone, methylisobutylketone and nitrocellulose.

The solvent system must retain the powder in the dispersed state. If conventionally used solvents such as benzene, toluene, xylene, trichloroethylene and the like are used, dispersion of the solid electrolyte is poor, dispersion is not well sustained and good films cannot be formed. Poor dispersions make the formation of a film difficult and poorly-sustained dispersion results in non-uniformity in film thickness.

If only alcohols or acetone is used alone, dispersion and stability of the dispersion are good, but adhesion of the film that is formed: is weak and uniform film thickness is not easily attained. The solvent tends to remain in the formed film, the surface of the formed film is rough, and cracking often occurs after drying.

A preferred dispersion solvent system for solid electrolyte is a mixture of methyl alcohol, a ketone or ketones derived therefrom, hexyl alcohol and nitrocellulose. A specific example thereof is a mixture of methyl alcohol, hexyl alcohol, acetone, methylisobutylketone and nitrocellulose.

In a solvent system to be used, 0.01–0.5%, preferably 0.05–0.2% by weight of nitrocellulose should be contained. The content ratio of alcohol and methyl-group-containing ketone is not specifically limited, although 30–50% by volume alcohol and 50–70% by volume ketones, more preferably 30–40% by volume alcohol and 55–70% by volume ketones are preferable.

Alcohols disperse solid electrolytes and sustain the dispersion for a prolonged time. Of alcohols, methyl alcohol is most effective for preparation of an excellent dispersion with good stability and gives flat and smooth films. Hexyl alcohol is effective for obtaining films of uniform thickness. Therefore, combined use of methyl alcohol and hexyl alcohol is preferable. In this case, hexyl alcohol is used in an amount of not more than 10% by volume of methyl alcohol.

Ketones derived from methyl alcohol are used. Specific examples are acetone, methylethylketone and methylisobutylketone. These ketones dissolve nitorcellulose and disperse solid electrolytes and as well as alcohols. Acetone acts to prevents flowing down of the the solvent system when the substrate on which film has been formed is drawn up out of the solvent system and this prevents formation of films with non-uniform thickness. Acetone is not decomposed by the applied electric potential, thus forms a good electric field. Among ketones acetone has highest stability against applied electric potential, but it can not give good adhesion of films. On the other hand, methylethylketone and methylisobutylketone bring about good adhesion of films. Combined use of acetone and methylisobutyl ketone is preferable in view of solubility of nitrocellulose and stability against applied electric potential. In this case, the content ratio of acetone and methylisobutylketone is not specifically limited, but it is preferred that the solvent system contains 20–40 parts by volume of acetone and 30–50 parts by volume of methylisobutylketone, preferably 20–30 parts by volume of the former and 35–45 parts by volume of the latter as the amount of the entire solvent system is 100 parts by volume.

Solid electrolytes are dispersed satisfactorily and the dispersion is well sustained in the above-described mixture of alcohols and ketones. Thus, uniformly thick and flat films can be prepared. However, when the thus formed film is dried, the film tends to crack. This cracking after drying can be prevented by addition of a small amount of nitrocellulose. When the above-mentioned mixed solvent of methyl alcohol, methylisobutylketone and acetone is used, only a small amount of nitrocellulose suffices.

An example of preferred composition of the mixed solvent is:

| | |
|---|---|
| Methyl alcohol | 28.0–35.0% by volume |
| Hexyl alcohol | 2.0–4.0% by volume |
| Acetone | 23.0–29.0% by volume |
| Methylisobutylketone | 35.0–45.0% by volume |
| Nitrocellulose | 0.05–0.2% by weight |

The substrate material connected to the cathode include: (1) plates of metallic platinum, stainless steel, etc., (2) pellets of compound metal oxide such as La-Sr-Co oxide, (3) pellets of insulator materials such as zirconia. At least two electrode terminals are provided on the substrate in the case of (2) and (3). By providing two terminals on two ends of a substrate, even insulator material substrates can be uniformly coated with film.

The quality and thickness of the films vary depending upon the composition of the solvent system used, the applied potential, the species and amount of the powder used, the period of of electric current conduction, and the like. By properly selecting these conditions, films of various properties and thicknesses can be prepared.

The above-described mixed solvents are expelled from the formed film by virtue of the electric potential gradient. Thus the formed films are of good quality and easily dried.

In the process of the present invention, the dispersion for electrophoresis is uniform and stable over a long period of time. Thus flat films of solid electrolytes free from cracks can be formed.

By the process of the present invention, films can be formed on the surface of insulator substances. Therefore, this invention enables continuous production of electrode/electrolyte/electrode multilayer films in the manufacture of high temperature type fuel cells using solid electrolytes. As a result, high performance solid electrolyte thick films can be efficiently produced with remarkable reduction in manufacturing time and cost.

In addition, according to the present invention, films can be formed regardless of the species of substrate materials, and thus films with multifunctions can be easily prepared. Further, film formation can be effected regardless of the shape of the substrate, and thus films can be formed on surfaces with complicated configurations.

BRIEF EXPLANATION OF THE ATTACHED DRAWINGS

DESCRIPTION OF EMBODIMENTS OF THE INVENTION

The invention will now be described by way of working examples with reference to the attached drawings.

EXAMPLE 1

Figure 1:
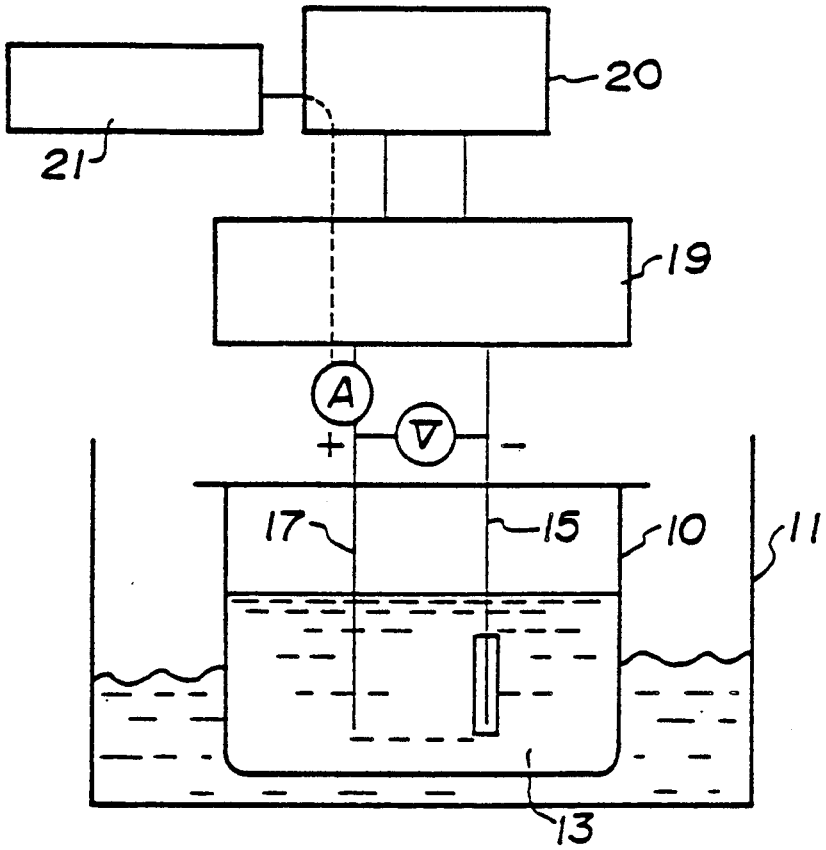
FIG. 1 is a schematic cross-sectional illustration of an apparatus for electrophoresis.
Figure 2:
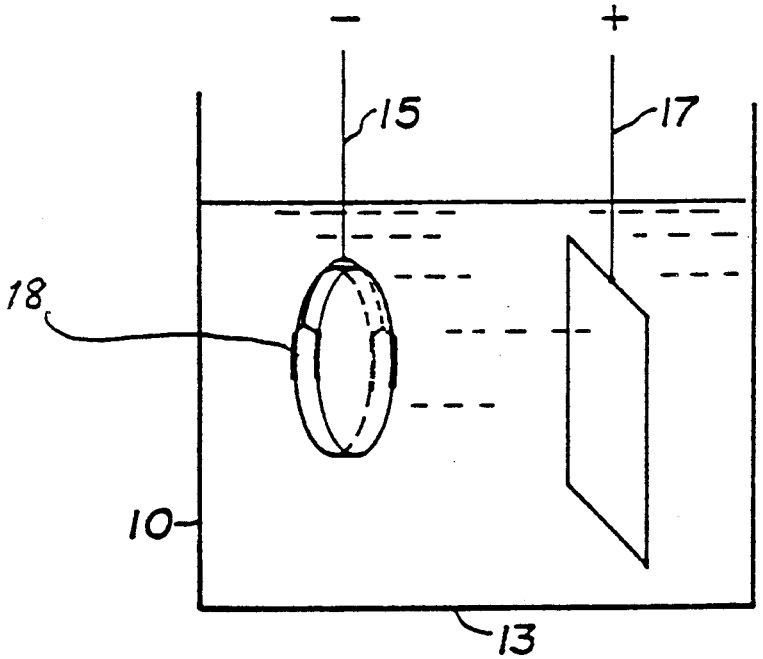
FIG. 2 is a schematic illustration of a cell in which a substrate of an insulator material is used as a cathode.

In the apparatus of FIG. 1, an electrophoretic cell 10 was placed in an ultrasonic wave generator 11 and the cell was filled with a solvent system 13. Electrodes 15 and 17 were provided in the cell. The electrodes are connected to an electric source 19 and a control system 20 and further a recording system 21 is provided. Rectangular wave form pulses of high voltage direct electric current were applied to the electrodes 15 and 17 by the electric source 19 and control system 20. The end of the electrode 15 was divided into two and each end forms fork-like terminals 18. Change in electric current which occurred during electrophoresis was recorded in the recording system 21. The powder of the starting material, composition of the employed solvent and conditions of electric current were as follows. Electrode substrates (1) to (4) indicated in the following table are provided with electrode terminals 18 as shown in FIG. 2.

Conditions of Electrophoresis

Powder: 3–8 mole % $Y_2O_3$-stabilized $ZrO_2$, particles size: <0.3 μm in, amount: 10.2 g Solvent: 26% by volume acetone, 39.9% by volume methylisobutylketone, 2.8% by volume hexyl alcohol, 31.3% methyl alcohol and 0.04% by weight nitrocellulose; total volume: about 60 ml Cathode: (1) stainless steel, (2) platinum plate, (3) $ZrO_2$, (4) $La_{05}Sr_{05}CoO_3$ sintered pellet Anode: Stainless steel or platinum plate Voltage: 100–600 V Deposition time: 3–180 sec.

Distance between the electrodes: 15 mm

Solvent system temperature: 25°–30° C.

Electrophoretic deposition was carried out under the above described conditions and films of 3–8 mole % $Y_2O_3$-stabilized $ZrO_2$ were formed on the cathode substrates (1)–(4). After the electrodeposition was finished, the substrates were taken out of the solvent system and dried. All the films were uniform in thickness, excellent in flatness and free from cracks.

Figure 3:
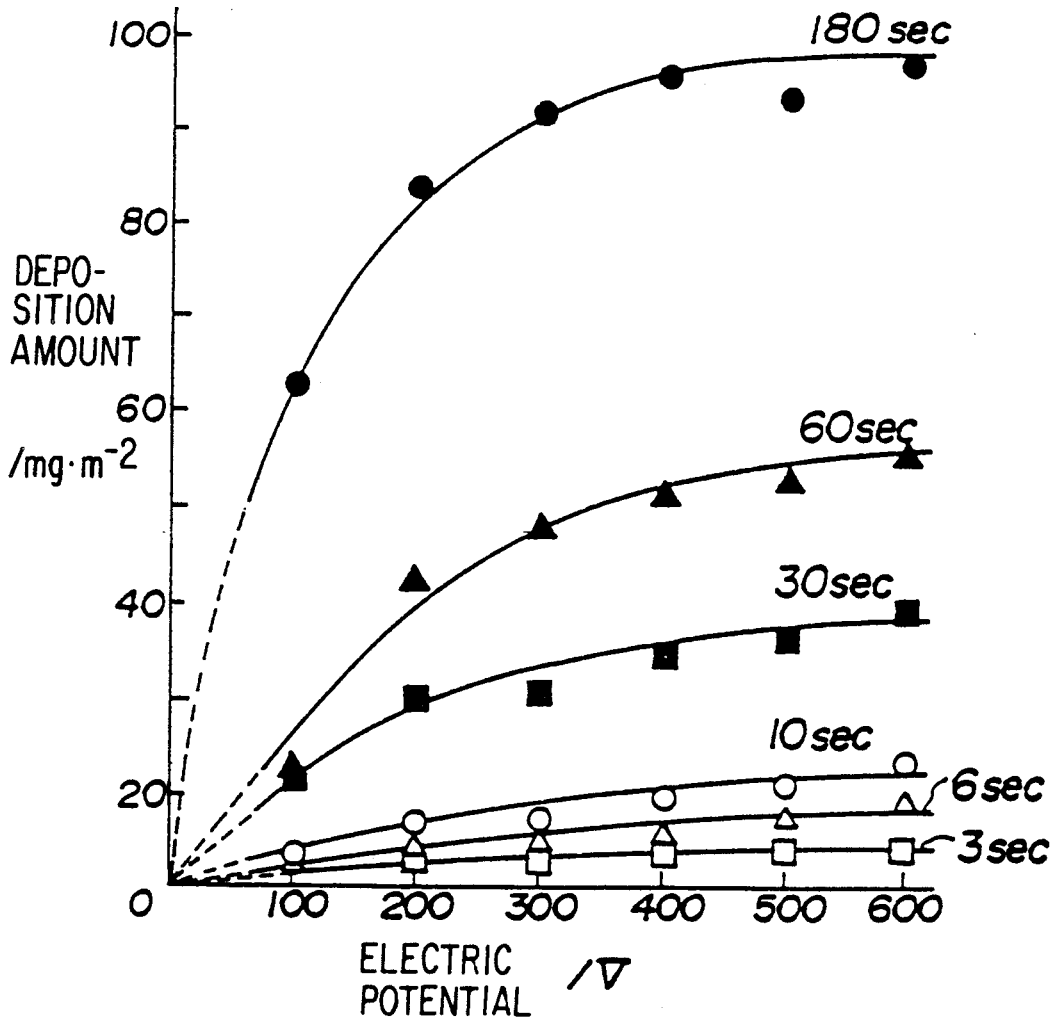
FIG. 3 and FIG. 4 show the results of Example 1.
Figure 4:
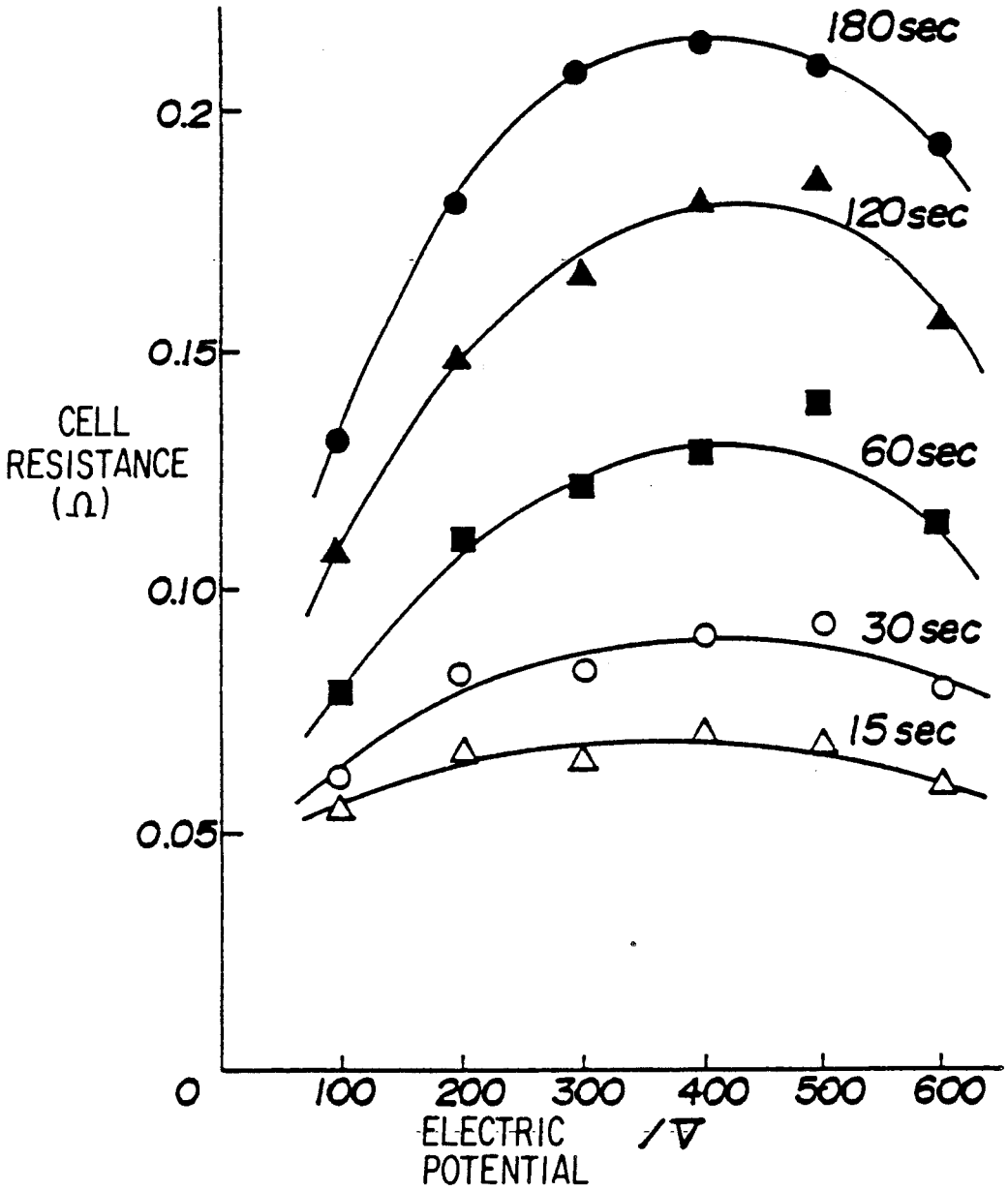

The relation between the voltage and the deposition amount is shown in FIG. 3. The relation between the voltage and the cell resistance is shown in FIG. 4. From FIG. 3, it is apparent that the amount of deposition is proportional to voltage up to 400 V, but deposition is saturated above 400 V. From FIG. 4, it is apparent that the cell resistance reaches maximum at around 400 V.

EXAMPLE 2

A multilayer film was formed on the surface of a stabilized zirconia pellet using the same apparatus used in Example 1 under the same conditions.

Figure 5:
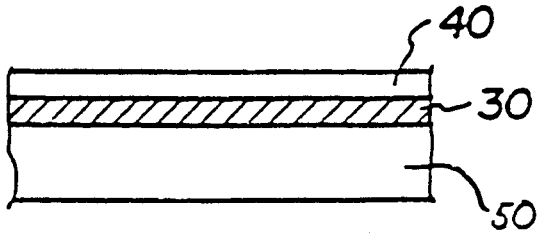
FIG. 5 is a cross-sectional view of a multilayer film and substrate prepared in Example 2.

First of all, 8 g of $La_{05}Sr_{05}CoO_3$ powder was dispersed in acetone and a film of said oxide was electrodeposited on the substrate by applying 300 V electric potential for 10 sec. Thereafter, 10.3 g of 3–8 m/o$Y_2O_3$-stabilized $ZrO_2$ powder was dispersed in about 60 ml of a mixed solvent system of 26% acetone, 39.9% methylisobutylketone, 2.8% hexyl alcohol, 31.3% methyl alcohol and 0.04 g (0.08% by weight) nitrocellulose, and solid electrolyte film was formed on the substrate by applying 300 V electric potential for 30 sec. The substrate was taken out and dried and the surface thereof was observed. As shown in FIG. 5, it was found that a film of compound oxide $La_{05}Sr_{05}CoO_3$ 30 and a film of $Y_2O_3$-stabilized $ZrO_2$ 40 were laminated on the insulator substrate of zirconia 50.

TEST

Using the same apparatus under the same electrophoresis conditions as in Example 1 but with varied solvent compositions films of $Y_2O_3$-stabilized $ZrO_2$ were formed. The results are shown in Table 2. From Tables 1 and 2, it was confirmed that a mixed solvent of alcohol or alcohols, a methyl-containing ketone or ketones and nitrocellulose give the best results.

TABLE 1

| Solvents | Acetone | MIBK | MEK | MeOH | PA + BA | nHA | B + T + X | ChE | THF |
|---|---|---|---|---|---|---|---|---|---|
| (1) Dispersion in solvent system by ultrasonic | | | | | | | x | x | |
| (2) Stability of dispersion | Δ | | | | | | x | x | x |
| (3) Adhesion of film | x | | | | Δ | | x | x | x |
| (4) Drying of solvent involved in film | | Δ | Δ | | Δ | | | | |
| (5) Uniformity in thickness of film | | Δ | Δ | | Δ | | | | |
| (6) Smoothness of film surface | | Δ | Δ | | Δ | | | | |
| (7) Occurrence of cracking | | yes | yes | yes | yes | yes | | | |
| (8) Solubility of nitrocellulose | | | | | | Δ | | | |
| (9) Stability of solvent system under applied electrical potential | | | | Δ | | | | | |

Notes
MIBK: methylisobutylketone
MEK: methyletylketone
MeOH: methyl alcohol
PA: Propyl alcohol
BA: butyl alcohol
nHA: n-hexyl alcohol
B: benzene
T: toluene
X: xylene
ChE: chloroethylene
TFH: tetrahydrofuran
: excellent
: good
Δ: fair
x: poor

TABLE 2

| Mixed solvent | (A):A + MA | (B):(A) + HA + MIBK | (C):(B) + NC |
|---|---|---|---|
| Overall evaluation of deposited film | Δ | | |
| Uniformity of film | | | |
| Smoothness of film surface | | | |
| Occurrence of cracks | Occurred | None | None |

Notes:
A = acetone
HA = hexyl alcohol
MIBK = methylisobutylketone
NC = nitrocellulose

We claim:

1. A process for electrophoretically depositing films of zirconia solid electrolyte comprising:

(a) dispersing $Y_2O_3$ stabilized zirconia powder in a solvent system consisting essentially of 30–50% by volume of one or more alcohols, 50–70% by volume of one or more methyl group-containing ketones and 0.001–0.5% by volume of nitrocellulose;

(b) applying direct electric potential between electrodes which are provided in the solvent system, thereby depositing the powder on a substrate connected to the cathode.

2. The process of claim 1 wherein said alcohols are methyl alcohol and hexyl alcohol.

3. The process of claim 1 wherein said solvent system consists essentially of methyl alcohol, hexyl alcohol, methylisobutyl ketone and nitrocellulose.

4. The process of claim 3 wherein said cathode is an insulator oxide material.

5. The process of claim 1 wherein an electrophoretic deposition is repeated with a different solid electrolyte powder, thereby forming a laminated multilayer film.

* * * * *